United States Patent [19]

Zahn et al.

[11] 4,171,126

[45] Oct. 16, 1979

[54] VACUUM FURNACE WITH COOLING MEANS

[75] Inventors: Frederick E. Zahn, Toledo, Ohio; David L. Checkley, Blissfield, Mich.; Wallace J. Titus, Toledo, Ohio

[73] Assignee: Midland-Ross Corporation, Cleveland, Ohio

[21] Appl. No.: 885,630

[22] Filed: Mar. 13, 1978

[51] Int. Cl.[2] ..... C21D 1/66; C21D 1/74

[52] U.S. Cl. ..... 266/250; 266/259

[58] Field of Search ..... 148/16; 266/250, 259; 432/205

[56] References Cited

U.S. PATENT DOCUMENTS

| | | | |
|---|---|---|---|
| 3,171,759 | 3/1965 | Glenn | 266/250 |
| 3,219,331 | 11/1965 | Ipsen | 266/250 |
| 3,301,541 | 1/1967 | Ipsen | 266/250 |
| 3,565,410 | 2/1971 | Scherff | 266/250 |
| 3,853,637 | 12/1974 | Gray | 148/16 |

*Primary Examiner*—Gerald A. Dost

*Attorney, Agent, or Firm*—Harlan E. Hummer

[57] ABSTRACT

A vacuum furnace having a single chamber in which a workpiece is supported and heat treated. A unique cooling system is designed for adaption with the low pressure/high volume radial flow fan which is positioned interiorly of the furnace adjacent the vertically uppermost portion of the chamber. The system includes an exhaust opening in the top of the chamber and a plurality of small openings strategically located in the lower half of the chamber for improving the uniformity of the flow pattern of cooled gas circulated upwardly through the chamber for cooling a workpiece positioned in the chamber.

13 Claims, 1 Drawing Figure

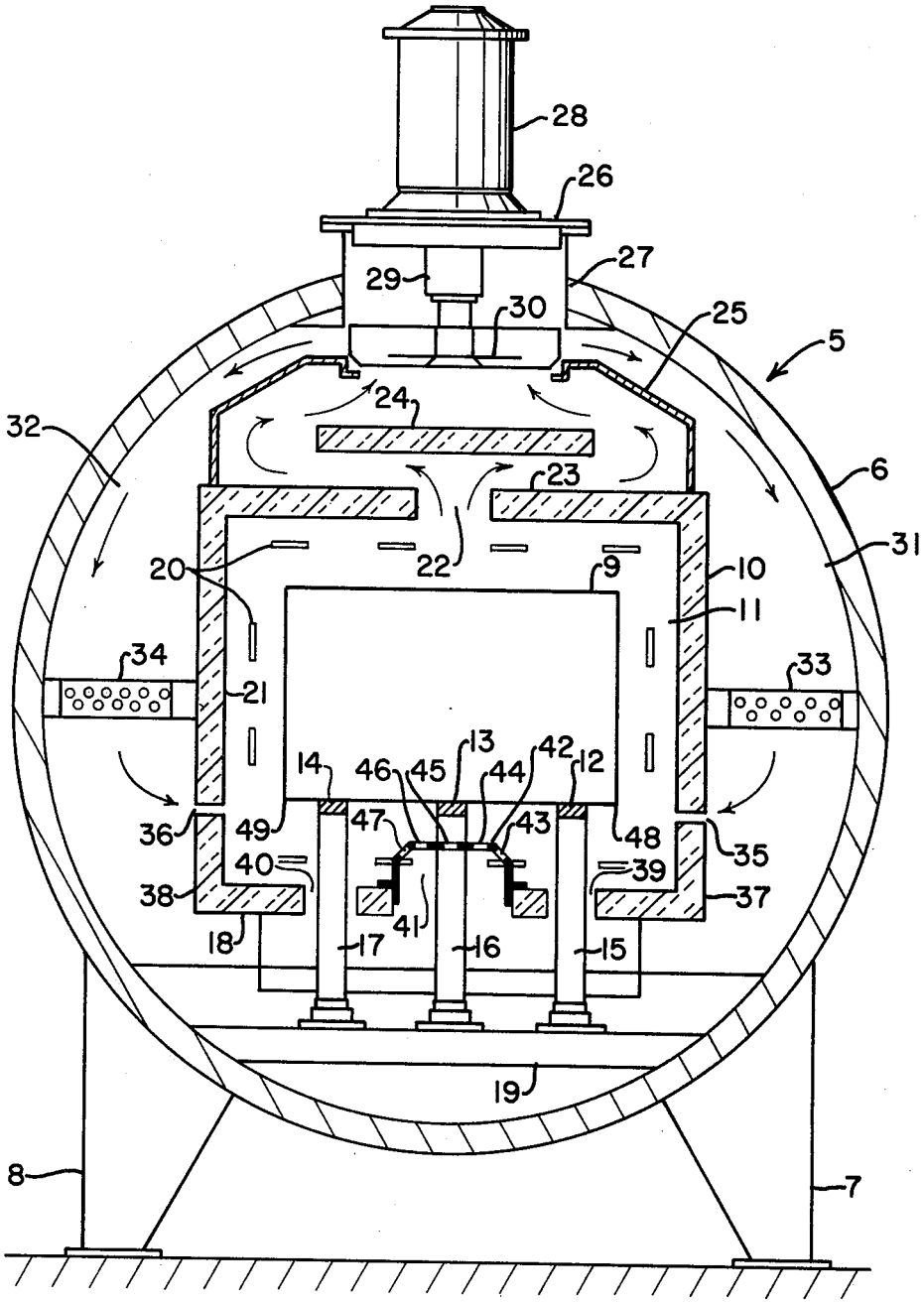
28
26
27
29
30
25
5
24
32
6
23
31
20
22
9
10
11
34
33
21
13
42
14
46
45
44
12
36
49
47
43
48
35
40
39
38
37
41
18
17
16
15
19
8
7

VACUUM FURNACE WITH COOLING MEANS

BACKGROUND OF THE INVENTION

The invention is an improvement in a single chambered vacuum furnace which is manufactured and sold by the Surface Division of Midland-Ross Corporation of Cleveland, Ohio, and especially in the cooling system of the furnace which is generally described in U.S. Pat. No. 3,565,410 that is typical of the many patents relating to such furnaces which normally employ low pressure/-high volume radial flow fans in their cooling systems which are located interiorly of the furnace. It has been the thinking that, because of the high volume of gas being moved by such fans, it is necessary to provide in the heat treatment chamber, large centrally disposed, axially aligned inlet and exhaust openings through which cooled gas is circulated upwardly through the chamber. The flow patterns of the gas created by this porting arrangement are restricted to the center portions of the chamber and, in some instances, cause uneven cooling of a workpiece positioned in the chamber. Thus, there is a need for improving the flow of gas through the chambers to create a more uniform cooling process.

Some vacuum furnaces, presently on the market, utilize a series of small nozzles which are equally spaced circumferentially around the chamber for directing high velocity jets of cooled gas against a workpiece disposed in the chamber. The gas is left to exit the chamber as best it can through crevices or openings between adjacent loosely fitted components. These specific furnaces use high pressure/low volume fans and cooling systems which are located exteriorly of the furnace, thereby making the furnaces bulkier and requiring more room than the furnaces with the interiorly located cooling systems. The gas is circulated through the nozzles at extremely high velocities in the range of from 10,000 to 12,000 fpm (feet per minute) as compared to the low velocities of 1,000–3,000 fpm at which the gas is circulated through the large single inlet and exhaust porting arrangement. The disadvantages of using such high velocities are well known in the trade.

It was discovered that the uniformity and rate of cooling in the furnace employing the low pressure/high volume fans was dramatically improved by using numerous small inlet openings in place of the single, large inlet of the heat treatment chamber. For example, the velocities of the gas in various parts of the chamber were measured and it was found that there was a 230% variation from the mean velocity when the old, single inlet and exhaust porting arrangement was used, whereas in the new multiple small inlet porting system, the deviation was radically reduced to 97%.

SUMMARY OF THE INVENTION

Briefly stated, the invention is in a vacuum furnace having a low pressure/high volume radial flow fan which is located interiorly of the furnace for circulating cooled gas through the heat treatment chamber of the furnace. The enclosed chamber is formed within a thermally insulated double walled casing which is disposed interiorly of an outer shell of the furnace. An exhaust outlet for the chamber is provided in the vertically uppermost portion of the casing. An improved gas distribution system in the form of a plurality of small inlet openings strategically located in the vertically lower half of the casing, is provided to increase the uniformity of the flow pattern of gas through the chamber. Gas, removed through the exhaust outlet from the chamber during the cooling cycle, is circulated through the cooling coils disposed in fluid passageways formed between the inner casing and outer shell of the furnace. The cooled gas is then circulated through the novel gas distribution system for impingement against a workpiece positioned in the chamber.

DESCRIPTION OF THE DRAWING

The following description of the invention will be better understood by having reference to the annexed drawing, which a cross-section of a vacuum furnace made in accordance with the invention, as viewed from a vertical plane when the furnace is in a normally vertical operating position.

ENVIRONMENT OF THE INVENTION

With reference to the drawing, there is shown a single chamber, vacuum furnace 5 which is similar in many respects to the furnace described in U.S. Pat. No. 3,565,410. The furnace 5 comprises a double-walled, liquid-cooled, outer cylindrical shell 6 which is supported horizontally on a plurality of vertically disposed legs 7,8. The cylindrical shell 6 has a pair of opposing ends which are normally sealed by covers, one of which is at least hinged so that it can be rotated out of position against the shell 6 to permit placement and removal of a workpiece 9 within the furnace 5.

A double-walled, thermally insulated casing 10 is disposed within the furnace 5 in spaced relation from the outer shell 6, and defines a heat treatment chamber 11 in which the workpiece 9 is supported on a plurality of horizontally disposed rails 12–14 that extend longitudinally of the chamber 11 and shell 6. The support rails 12–14 are supported, in turn, on a plurality of vertical posts 15–17 which extend through the bottom 18 of the casing 10 and are secured to framework 19 carried by the shell 6. A plurality of similar heaters 20 are disposed within the chamber 11 adjacent the inner periphery 21 of the casing 10. A large exhaust outlet 22 is centrally disposed in the top 23 of the casing 10. The exhaust outlet 22 is an elongated slot which extends longitudinally of the chamber 11 and has a transverse width of from 6 to 8 inches, depending on the size of the furnace 5. A baffle 24, spaced above the exhaust outlet 22 of the chamber 11, is disposed in a hood 25 which substantially covers the top 23 of the casing 10. A fan 26 is mounted in the hood 25 for circulating gas to and from the chamber 11. The fan 26 comprises an electrically operated motor 28 which is disposed exteriorly of the shell 6. The motor 28 is coupled by a drive shaft 29 to a blade or impeller 30 which is disposed internally of the shell 6 in communication with the hood 25. The fan 26 is a conventional low pressure/high volume radial flow fan which is capable of circulating gas, for example, at a volume of about 6,000 cfm (cubic feet per minute) and at a static pressure not exceeding one inch of water. The fan 26, during the cooling cycle and upon completion of the heat treatment of the workpiece 9, removes hot gas from the hood 25 and chamber 11 and circulates it in a radial direction into a pair of fluid passageways 31,32, formed between the inner casing 10 and outer shell 6. A pair of cooling coils 33,34, disposed in the fluid passageways 31,32, are designed to cool gas circulated therethrough by temperatures in the range of from 300° F. to 500° F.

THE INVENTION

A plurality of circular openings 35,36 are disposed in the lower sidewalls 37,38 of the casing 10 adjacent the bottom 18. The openings 35,36 are about 1–1½ inches in diameter, and are spaced longitudinally of the casing 10 about six inches apart. A pair of annular openings 39,40 are disposed around each of the vertical posts 15–17 which extend through the casing 10. As previously indicated, the vacuum furnace 5 normally has a large centrally disposed inlet opening 41 in the bottom 18 of the casing 10. This inlet opening 41 is generally an elongated slot which extends longitudinally of the casing 10 and has a transverse width that varies from 6 to 12 inches, depending on the size of the furnace 5.

A specially configured metal plenum 42 covers the inlet 41. The plenum 42 may be permanently secured to the casing 10, or removably positioned in the inlet 41 by any suitable means, e.g. flanges depending from the plenum 40 for supporting engagement with the casing 10 adjacent the inlet 41. In any case, the metal plenum 42 is provided with a plurality of openings 43–47 to more uniformly distribute cooled gas in the chamber 11 for contact with the workpiece 9. The multiple inlet openings 35,36,39,40, 43–47 are properly sized and strategically located in the chamber 11 to provide a highly improved system for uniformly distributing cooled gas throughout the chamber 11 at comparatively low velocities not exceeding, for example, 3,000 fpm. This improved gas distribution system or porting arrangement, causes more uniformly cooling of the workpiece 9, especially at the lower outer corners 48,49 which have been found to be critical areas in the cooling of a workpiece. The openings 35,36 in the lower sidewalls 37,38 of the casing 10, are located on the level of the support rails 12–14 so as to direct cooled gas against the lower outer corners 48,49 of the workpiece 9. The cooled gas from the lower sidewall openings 35,36 collide with cooled gas emitting from the adjacent annular openings 39,40 to create sufficient turbulence in the areas of the support rails 12–14 so as to properly and uniformly cool the lower edges 48,49 of the workpiece 9. The cooled gas is more evenly dispersed in the chamber 11 by properly sizing the openings, so that the total gas discharge area of the openings 43–47 in the metal plenum 42 equals the total gas discharge area of the other inlet openings 35,36,39,40. This produces a well balanced cooling system.

It has been found that the multiple inlet openings and single exhaust opening porting arrangement is highly effective in uniformly cooling a workpiece which has been exposed during heat treatment to hot gas having very high temperatures in the range of from 1200° F. to 2400° F. Thus, the uniformity of the flow pattern of cooled gas through the heat treatment chamber of the vacuum furnace has been highly improved from what it was using, the single inlet and exhaust portion combination. It has been found highly effective to position the inlet openings in the lower half of the casing, rather than space them equally around the inner periphery of the casing as is done in other vacuum furnaces which employ high velocity nozzles for circulating cooled gas into the heat treatment chamber.

What is claimed is:

1. A vacuum furnace, comprising:

(a) a generally hollow shell sealable from the ambient atmosphere;

(b) a casing disposed within the surrounding shell and spaced therefrom, the casing defining a heat treatment chamber within the furnace;

(c) means for supporting within the chamber, a workpiece to be heat treated including:

(I) a plurality of elongated rails which support the workpiece and extend longitudinally of the chamber; and (II) a plurality of posts supporting each of the rails and extending through the casing;

(d) means disposed within the chamber for heating a workpiece disposed therein;

(e) a sufficient number of adequately sized inlet openings strategically located in the vertically lower half of the casing for directing cooled gas at relatively low velocities not exceeding 3,000 fpm into the chamber, the openings being the only means for directing gas into the chamber and including an annular opening in the casing around each of the posts;

(f) at least one large exhaust outlet, as compared to the size of an inlet opening, disposed in the vertically uppermost portion of the casing through which gas exits the chamber, any of such outlets being sized so as not to adversely affect the flow of gas vertically upwardly through the chamber;

(g) means disposed interiorly of the furnace for cooling gas circulated between the exhaust outlet and inlet openings; and (h) a fan, including an impeller located interiorly of the furnace, for circulating gas from the chamber through the exhaust outlet, then through the cooling means and then through the many inlet openings into the chamber at velocities not exceeding 3,000 fpm.

2. The furnace of claim 1, wherein the inlet openings include a plurality of similar openings disposed in lower sidewalls of the casing adjacent the vertically lowest portion of the casing, for directing gas towards the rails which support the workpiece.

3. The furnace of claim 2, wherein the inlet openings in the casing include:

(III) an elongated slot disposed centrally in the vertically lowest portion of the casing, the slot extending longitudinally of the chamber;

(IV) a metal plenum covering the slot; and (V) a plurality of openings disposed in the metal plenum.

4. The furnace of claim 3, wherein the total gas discharge area of the openings in the plenum substantially equals the total gas discharge area of the other inlet openings.

5. The furnace of claim 4, wherein the gas cooling means includes a cooling coil disposed in each of a pair of fluid passageways connecting the inlet openings and exhaust outlet of the chamber.

6. The furnace of claim 5, which includes a hood connecting the fan and exhaust outlet.

7. The furnace of claim 6, wherein the circular inlet openings have an inside diameter of about 1 to 1½ inches.

8. A vacuum furnace, comprising:

(a) a horizontally disposed double-walled, cooled, cylindrical shell having opposing ends;

(b) means for sealing the opposing ends of the shell;

(c) a thermally insulated, double-walled casing disposed in the furnace in spaced relation from the shell;

(d) a single exhaust outlet centrally disposed in the vertically uppermost portion of the casing and extending longitudinally of the casing and shell and through which gas exits the chamber;

(e) a slot centrally disposed in the vertically lowermost portion of the casing and extending longitudinally of the casing and shell;

(f) a metal plenum covering the slot and including a plurality of properly sized and located openings which act to distribute gas evenly into the chamber at low velocities not exceeding 3,000 fpm.

(g) a plurality of rails disposed in the chamber and extending longitudinally thereof to support a workpiece in the furnace;

(h) a plurality of posts supporting the rails and extending downwardly through the casing for securement to the shell;

(i) an annular opening surrounding each post extending through the casing for directing gas into the chamber at low velocities;

(j) a plurality of openings disposed in lower sidewalls of the casing adjacent the vertically lowermost portion thereof to direct gas into the chamber adjacent vertically lowermost edges of a workpiece on the rails, the gas discharge area of the openings in the metal plenum substantially equalling the gas discharge area of the other inlet openings;

(k) a pair of gas passageways disposed between the casing and shell for connecting the exhaust outlet and inlet openings;

(l) means disposed in each of the gas passageways for cooling gas circulating between the exhaust outlet and nozzles;

(m) a fan communicating with the gas passageways for circulating gas from the exhaust outlet to the inlet openings and into the chamber at low velocities not exceeding 3,000 fpm.

9. The vacuum furnace of claim 8, wherein the fan is capable of circulating gas at a volume flow of at least 6,000 cfm.

10. The vacuum furnace of claim 8, which includes means for removably mounting the plenum in covering relation over the slot.

11. A vacuum furnace, comprising:

(a) a generally hollow shell sealable from the ambient atmosphere;

(b) a casing disposed within the surrounding shell and spaced therefrom, the casing having a vertically uppermost top, a vertically lowermost bottom, and sidewalls therebetween defining a heat treatment chamber within the furnace;

(c) means for supporting within the chamber, a workpiece to be heat treated;

(d) means disposed within the chamber for heating a workpiece disposed therein;

(e) a number of inlet openings strategically located in the vertically lower half of the casing for directing cooled gas into the chamber, the openings being the only means for directing cooled gas into the chamber, each of the openings being small compared to an exhaust outlet as hereinafter described, the inlet openings including:

(I) a plurality of the small openings disposed in the bottom of the casing to direct streams of cooled gas in a vertical direction towards a workpiece disposed within the chamber; and (II) a plurality of the small openings disposed in the sidewalls of the casing to direct streams of cooled gas in a horizontal direction towards a workpiece disposed within the chamber;

(f) at least one large exhaust outlet, as compared to the size of an inlet opening, disposed in the vertically uppermost top of the casing through which gas exits the chamber, said at least one large exhaust outlet being sized so as not to adversely affect the flow of gas vertically upwardly through the chamber;

(g) means disposed interiorly of the furnace for cooling gas circulated between the exhaust outlet and inlet openings; and (h) a low pressure/high volume type fan, including an impeller located interiorly of the furnace, for successively circulating gas from the chamber through the exhaust outlet, then through the cooling means and then through the inlet openings into the chamber.

12. The vacuum furnace of claim 11, wherein the inlet openings in the bottom of the casing include:

(I) a large slot centrally disposed in the vertically lowermost bottom of the casing and extending longitudinally thereof;

(II) a metal plenum covering the slot;

(III) a plurality of openings disposed in the plenum for distributing gas more evenly in the chamber at relatively low velocities not exceeding 3,000 feet per minute.

13. The vacuum furnace of claim 12, wherein the support means includes a pair of parallel rails, and the inlet openings in the sidewalls and certain inlet openings in the bottom of the casing are positioned to direct streams of cooled gas which intersect adjacent the rails.

* * * * *